US010135155B2

(12) United States Patent
Sudo et al.

(10) Patent No.: US 10,135,155 B2
(45) Date of Patent: Nov. 20, 2018

(54) WIRELESS COMMUNICATION MODULE

(71) Applicant: Murata Manufacturing Co., Ltd., Kyoto (JP)

(72) Inventors: Kaoru Sudo, Kyoto (JP); Hideki Ueda, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 29 days.

(21) Appl. No.: 15/491,283

(22) Filed: Apr. 19, 2017

(65) Prior Publication Data

US 2017/0222333 A1 Aug. 3, 2017

Related U.S. Application Data

(63) Continuation of application No. PCT/JP2015/078791, filed on Oct. 9, 2015.

(30) Foreign Application Priority Data

Oct. 20, 2014 (JP) ..... 2014-213385

(51) Int. Cl.
*H01Q 13/00* (2006.01)
*H01Q 21/24* (2006.01)
(Continued)

(52) U.S. Cl.
CPC ..... *H01Q 21/245* (2013.01); *H01Q 1/38* (2013.01); *H01Q 3/34* (2013.01); *H01Q 3/38* (2013.01);
(Continued)

(58) Field of Classification Search
CPC ..... H01Q 5/55; H01Q 21/0093; H01Q 9/045; H01Q 9/0407; H01Q 1/48; H05K 1/0218;
(Continued)

(56) References Cited

U.S. PATENT DOCUMENTS 6,646,615 B2 * 11/2003 Andrews ..... H01Q 21/24 343/726
6,844,858 B2 * 1/2005 Andrews ..... H01Q 21/24 343/725
(Continued)

FOREIGN PATENT DOCUMENTS

EP 2 253 076 11/2010
JP H02-070104 A 3/1990
(Continued)

OTHER PUBLICATIONS

International Search Report issued in Application No. PCT/JP2015/078791 dated Dec. 28, 2015.
(Continued)

*Primary Examiner* — Khai M Nguyen
(74) *Attorney, Agent, or Firm* — Pearne & Gordon LLP

(57) ABSTRACT

First and second end-fire antennas are arranged on a dielectric substrate. The first end-fire antenna has polarization characteristics being parallel with a first direction. The second end-fire antenna has polarization characteristics being parallel with a second direction orthogonal to the first direction. A patch antenna provided with a first feed point and a second feed point, which are different from each other, is arranged on the dielectric substrate. When the patch antenna is fed from the first feed point, a radio wave whose polarization direction is parallel with the first direction is excited. When the patch antenna is fed from the second feed point, a radio wave whose polarization direction is orthogonal to the first direction is excited. A wireless communication module capable of achieving directivity in a wide range from a direction parallel with the substrate to the direction of the normal to the substrate is provided.

9 Claims, 7 Drawing Sheets

(51) Int. Cl.

| | |
|---|---|
| ***H01Q 1/38*** | (2006.01) |
| ***H01Q 13/08*** | (2006.01) |
| ***H01Q 3/34*** | (2006.01) |
| ***H01Q 21/06*** | (2006.01) |
| ***H01Q 3/38*** | (2006.01) |
| *H01Q 19/06* | (2006.01) |
| *H01Q 25/00* | (2006.01) |

(52) U.S. Cl.
CPC ..... *H01Q 13/08* (2013.01); *H01Q 21/065* (2013.01); *H01Q 21/067* (2013.01); *H01Q 21/24* (2013.01); *H01Q 19/062* (2013.01); *H01Q 25/00* (2013.01)

(58) Field of Classification Search
CPC ..... H05K 1/0239; H05K 1/115; H05K 2201/09363; H05K 2201/09618; H01P 5/087; H01P 3/16; H01P 3/121; H01P 5/107
USPC ..... 343/700 MS, 777
See application file for complete search history.

(56) References Cited

U.S. PATENT DOCUMENTS

| | | | | |
|---|---|---|---|---|
| 8,179,325 | B2 * | 5/2012 | Edwards | H01Q 9/0407 343/700 MS |
| 2010/0280340 | A1 | 11/2010 | Homan | |
| 2011/0006960 | A1 | 1/2011 | Edwards | |
| 2015/0194730 | A1 | 7/2015 | Sudo | |

FOREIGN PATENT DOCUMENTS

| | | | |
|---|---|---|---|
| JP | 2003-008337 | A | 1/2003 |
| JP | 4603098 | B2 | 12/2010 |
| WO | 2009/114486 | A2 | 9/2009 |
| WO | 2014/045966 | A1 | 3/2014 |

OTHER PUBLICATIONS

Written Opinion issued in Application No. PCT/JP2015/078791 dated Dec. 28, 2015.

* cited by examiner 10
55
56
57
58
z
x
y
211
212
221
222
223
224
231
232
311
312
313
314
321
322
323
324
241
242
243
244
6B
6B
40
41
42
43
44
RECEIVING CIRCUIT
y (90°)
x (0°)
z

WIRELESS COMMUNICATION MODULE

This is a continuation of International Application No. PCT/JP2015/078791 filed on Oct. 9, 2015 which claims priority from Japanese Patent Application No. 2014-213385 filed on Oct. 20, 2014. The contents of these applications are incorporated herein by reference in their entireties.

BACKGROUND OF THE DISCLOSURE

Field of the Disclosure

The present disclosure relates to a wireless communication module including a boresight antenna and an end-fire antenna.

Description of the Related Art

Patent Document 1 listed below discloses an antenna assembly including a combination of a planar antenna and an end-fire antenna. The planar antenna constitutes a phased array antenna. The phased array antenna can provide beams in a wave angle direction with respect to a substrate. The end-fire antenna can provide beams in a direction parallel with the substrate.

Patent Document 2 listed below discloses a dual-polarized antenna in which a passive element is electromagnetically coupled to a feeding element. The passive element has a cross shape in which a first patch extending in the x direction and a second patch extending in the y direction are orthogonal to each other. The feeding element is fed from two feed points at an intermediate position in the x direction and at an intermediate position in the y direction. The patch antenna enables excitation of two polarized waves orthogonal to each other.

Patent Document 1: European Patent Application Publication No. 2253076

Patent Document 2: International Publication No. 2014-045966

BRIEF SUMMARY OF THE DISCLOSURE

The antenna assembly disclosed in Patent Document 1 has difficulty in efficiently radiating radio waves in a direction corresponding to the border between a radiation available area covered by the planer antenna and a radiation available area covered by the end-fire antenna.

The dual-polarized antenna disclosed in Patent Document 2 has directivity in the direction of the normal to the substrate (boresight direction). This antenna has difficulty in efficiently radiating radio waves in a direction parallel with the substrate (end-fire direction).

It is an object of the present disclosure to provide a wireless communication module capable of achieving directivity in a wide range from a direction parallel with a substrate to the direction of the normal to the substrate.

A wireless communication module according to a first aspect of the present disclosure includes a dielectric substrate, at least one first end-fire antenna arranged on the dielectric substrate, having directivity in a direction parallel with a surface of the dielectric substrate, and having polarization characteristics being parallel with a first direction, at least one second end-fire antenna arranged on the dielectric substrate, having directivity in the direction parallel with the surface of the dielectric substrate, and having polarization characteristics being parallel with a second direction orthogonal to the first direction, and at least one patch antenna arranged on the dielectric substrate and provided with a first feed point and a second feed point, the first and second feed points being different from each other.

When the patch antenna is fed from the first feed point, a radio wave whose polarization direction is parallel with the first direction is excited, and when the patch antenna is fed from the second feed point, a radio wave whose polarization direction is orthogonal to the first direction is excited.

When the patch antenna is fed from the first feed point, the first end-fire antenna and the patch antenna operate as an array antenna. Thus, the directivity can be changed continuously in a range from the end-fire direction covered by the first end-fire antenna to the boresight direction covered by the patch antenna.

The wireless communication module according to a second aspect of the present disclosure may have the configuration described below, in addition to the configuration of the wireless communication module according to the first aspect.

When the patch antenna is fed from the second feed point, a radio wave whose polarization direction is parallel with the second direction may be radiated.

When the patch antenna is fed from the second feed point, the second end-fire antenna and the patch antenna operate as an array antenna. Thus, the directivity can be changed continuously in a range from the end-fire direction covered by the second end-fire antenna to the boresight direction covered by the patch antenna.

The wireless communication module according to a third aspect of the present disclosure may have the configuration described below, in addition to the configuration of the wireless communication module according to the second aspect.

The at least one patch antenna may include a plurality of patch antennas having an array antenna structure in which they are aligned in a matrix in the first direction and the second direction.

Because the patch antennas have a two-dimensional array antenna structure, the directivity can be changed in the two-dimensional direction with respect to the boresight direction.

The wireless communication module according to a fourth aspect of the present disclosure may have the configuration described below, in addition to the configuration of the wireless communication module according to the third aspect.

The number of the patch antennas aligned in the first direction may be larger than the number of the patch antennas aligned in the second direction, each of one or more of the patch antennas may be configured to be fed from the first feed point and the second feed point, and each of the remaining patch antennas may be configured to be fed from only the second feed point.

Because the number of the feed points is reduced, the number of phase shifters for adjusting the phases of high-frequency signals supplied to the antennas can be reduced. The difference between the number of the antennas configured to excite a polarized wave in the first direction and that in the second direction is reduced. Thus, the radiation characteristics for two polarized waves can be matched with each other.

The wireless communication module according to a fifth aspect of the present disclosure may have the configuration described below, in addition to the configuration of the wireless communication module according to the third or fourth aspect.

The at least one first end-fire antenna may include a plurality of first end-fire antennas having an array antenna structure in which they are aligned in the first direction, and the at least one second end-fire antenna may include a plurality of second end-fire antennas having an array antenna structure in which they are aligned in the second direction.

The directivity of the first end-fire antennas and the directivity of the second end-fire antennas can be changed in directions of azimuth angles.

The wireless communication module according to a sixth aspect of the present disclosure may have the configuration described below, in addition to the configuration of the wireless communication module according to the sixth aspect.

High-frequency signals whose phases are adjusted independently of each other through phase shifters may be capable of being supplied to the first end-fire antennas, and high-frequency signals having the same phase may be supplied to the second end-fire antennas.

The directivity of the second end-fire antennas can be sharpened.

The wireless communication module according to a seventh aspect of the present disclosure may have the configuration described below, in addition to the configuration of the wireless communication module according to the third aspect.

The number of the patch antennas aligned in the first direction may be larger than the number of the patch antennas aligned in the second direction, and the wireless communication module may further include an electromagnetic lens configured to converge radio waves radiated by the second end-fire antenna.

The directivity of the second end-fire antenna can be further sharpened.

The wireless communication module according to an eighth aspect of the present disclosure may have the configuration described below, in addition to the configuration of the wireless communication module according to the first aspect.

One of the first direction and the second direction may be parallel with the surface of the dielectric substrate, and the other direction may be parallel with a thickness direction of the dielectric substrate.

A polarized wave parallel with the thickness direction of the dielectric substrate can be excited.

When the patch antenna is fed from the first feed point, the first end-fire antenna and the patch antenna operate as an array antenna. Thus, the directivity can be changed continuously in a range from the end-fire direction covered by the first end-fire antenna to the boresight direction covered by the patch antenna.

BRIEF DESCRIPTION OF THE SEVERAL VIEWS OF THE DRAWINGS

FIG. 6B is a cross-sectional view taken along a dot-and-dash line 6B-6B in FIG. 6A.

DETAILED DESCRIPTION OF THE DISCLOSURE

First Embodiment

Figure 1:
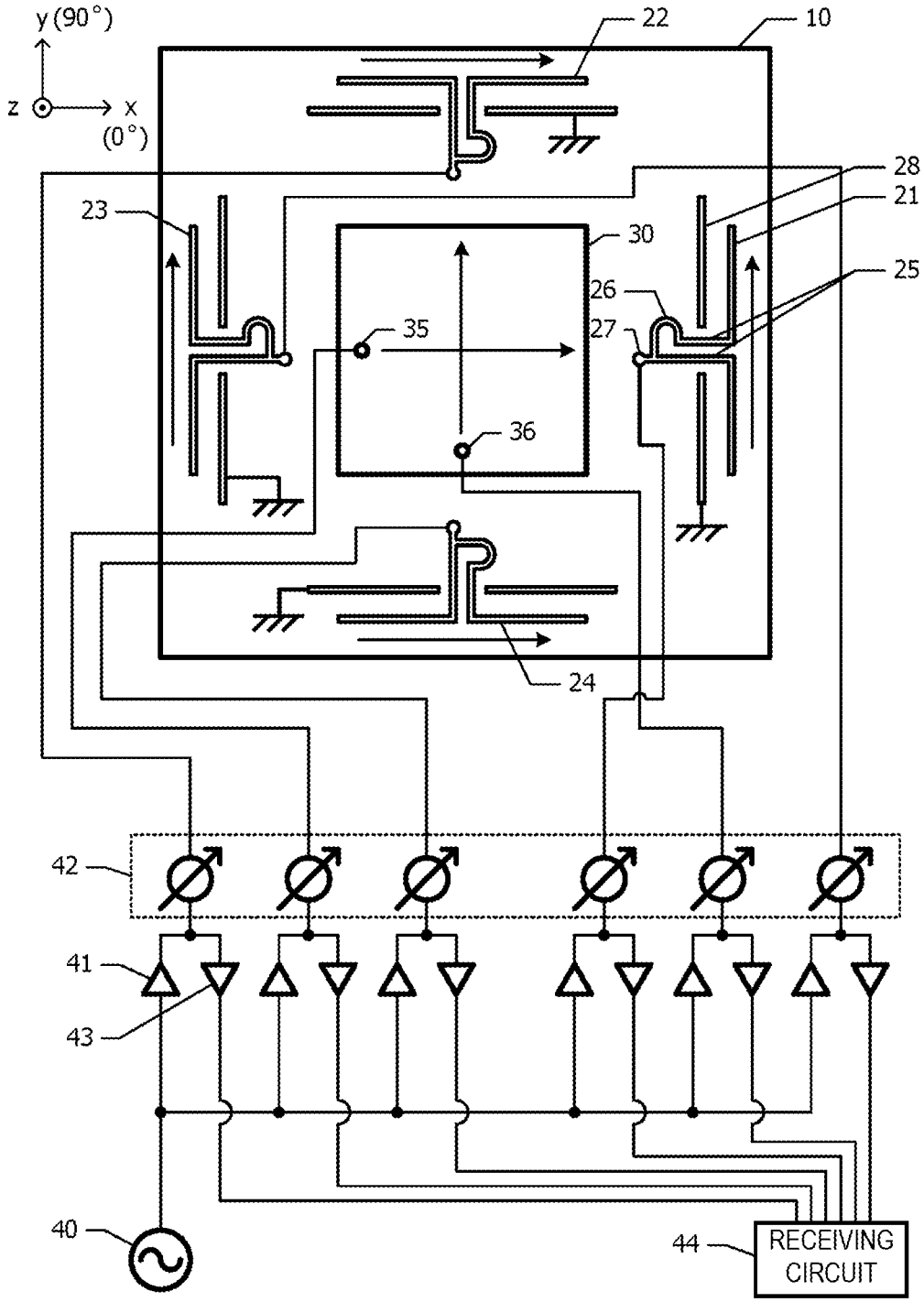
FIG. 1 includes a plan view of a wireless communication module according to a first embodiment and a block diagram of a signal transmitting and receiving circuit.

FIG. 1 illustrates a plan view of a wireless communication module according to a first embodiment and a block diagram of a signal transmitting and receiving circuit. In the drawings, an xyz rectangular coordinate system is defined in which the x-axis direction and y-axis direction are directions parallel with the surface of a dielectric substrate 10 and the z-axis direction is a normal direction thereto. The dielectric substrate 10 has a planar shape of a square or rectangle having parallel sides in the x-axis direction or y-axis direction.

Four end-fire antennas 21 to 24 and one patch antenna 30 are arranged on the dielectric substrate 10. Each of the end-fire antennas 21 to 24 has directivity whose main lobe extends in a direction parallel with the surface of the dielectric substrate 10 (end-fire direction). When the azimuth angle in the positive side in the x-axis direction is defined as 0 degree and the azimuth angle in the positive side in the y-axis direction is defined as 90 degrees, the end-fire antennas 21 to 24 have the directivities with main lobes extending along the directions of azimuth angles of 0 degree, 90 degrees, 180 degrees, and 270 degrees, respectively.

A printed dipole antenna may be used as one example of each of the end-fire antennas 21 to 24. A balanced feeder 25 extends from the end-fire antenna 21 toward the inner side of the dielectric substrate 10. A balanced-to-unbalanced transformer (balun) 26 is interposed in the base of the balanced feeder 25. The balun 26 is connected to a lower transmission line with a node 27 interposed therebetween. High-frequency signals are supplied from the node 27 through the balun 26 and balanced feeder 25 to the end-fire antenna 21.

A reflector pattern 28 is arranged between the end-fire antenna 21 and balun 26. The reflector pattern 28 includes a linear pattern extending in a direction parallel with the end-fire antenna 21. The reflector pattern 28 is disconnected at the location of the balanced feeder 25 and is insulated from the balanced feeder 25. The reflector pattern 28 is connected to a lower ground layer. The distance between the end-fire antenna 21 and reflector pattern 28 is approximately ¼ of an effective wavelength at an operation frequency of the end-fire antenna 21. The reflector pattern 28 is paired with the end-fire antenna 21 and functions as a reflector. Similarly, a high-frequency signal is supplied from the node through the balun and balanced feeder to each of the other end-fire antennas 22 to 24. Reflector patterns paired with the respective end-fire antennas 22 to 24 are also arranged.

The end-fire antennas 21 to 24 are arranged for respective sides of the dielectric substrate 10. Each of the end-fire antennas 21 and 23 includes a radiating element extending in parallel with the y axis, and its polarization direction is parallel with the y axis. Each of the other end-fire antennas 22 and 24 includes a radiating element extending in parallel with the x axis, and its polarization direction is parallel with the x axis. That is, the polarization direction of each of the end-fire antennas 21 and 23 is orthogonal to the polarization direction of each of the other end-fire antennas 22 and 24.

The patch antenna 30 has a square planar shape, and each of its sides is parallel with the x axis or y axis. The patch antenna 30 is arranged inside an area surrounded by the end-fire antennas 21 to 24. The end-fire antenna 23, patch antenna 30, and end-fire antenna 21 are arranged in this order in the x-axis direction. The end-fire antenna 24, patch antenna 30, and end-fire antenna 22 are arranged in this order in the y-axis direction.

The patch antenna 30 is fed from a first feed point 35 and a second feed point 36. The first feed point 35 is arranged at a location deviating from the center of the patch antenna 30 in the x-axis direction (to the left side in FIG. 1). The second feed point 36 is arranged at a location deviating from the center of the patch antenna 30 in the y-axis direction (to the lower side in FIG. 1).

When the patch antenna 30 is fed from the first feed point 35, a polarized wave parallel with the x axis is excited. At this time, the polarization direction of the radio wave radiated by the patch antenna 30 is parallel with the polarization direction of the end-fire antenna 22 and end-fire antenna 24. When the patch antenna 30 is fed from the second feed point 36, a polarized wave parallel with the y axis is excited. At this time, the polarization direction of the radio wave radiated by the patch antenna 30 is parallel with the polarization direction of the end-fire antenna 21 and end-fire antenna 23.

High-frequency signals are supplied from a transmitting circuit 40 through power amplifiers 41 and digital phase shifters 42 to the end-fire antennas 21 to 24, first feed point 35, and second feed point 36. High-frequency signals received by the antennas are supplied to the digital phase shifters 42 to low-noise amplifiers 43 to a receiving circuit 44. The digital phase shifters 42 for the end-fire antennas 21 to 24, first feed point 35, and second feed point 36 can adjust the phases of high-frequency signals independently of each other. The digital phase shifters 42 have the function of selecting the antenna and feed point to transmit or receive a signal from among the end-fire antennas 21 to 24, first feed point 35, and second feed point 36 (the function of switching for each antenna). A high-frequency signal is supplied from the transmitting circuit 40 to only the selected antenna and feed point, and high-frequency signal is supplied from only the selected antenna and feed point to the receiving circuit 44.

The main lobe can be oriented to a target wave angle direction with respect to the zx in-plane by adjusting the phase of a high-frequency signal supplied to the end-fire antenna 21, second feed point 36, and end-fire antenna 23. At this time, the end-fire antenna 21, patch antenna 30, and end-fire antenna 23 operate as one set of an array antenna.

The main lobe can be oriented to a target wave angle direction with respect to the yz in-plane by adjusting the phase of a high-frequency signal supplied to the end-fire antenna 22, first feed point 35, and end-fire antenna 24. At this time, the end-fire antenna 22, patch antenna 30, and end-fire antenna 24 operate as one set of an array antenna.

In the first embodiment, digital beamforming can be achieved in a wide range for the wave angle direction by combining the phase of a radio wave radiated by the patch antenna 30 and the phase of a radio wave radiated by each of the end-fire antennas 21 to 24. The patch antenna 30 operates as an antenna for two crossed polarized waves. Thus, the patch antenna 30 can be utilized as an antenna for digital beamforming with respect to the wave angle direction in the zx plane and as an antenna for digital beamforming with respect to the wave angle direction in the yz plane.

In the wireless communication module according to the first embodiment, the end-fire antennas 21, 22, 23, and 24 are arranged for the four directions of azimuth angles of 0 degree, 90 degrees, 180 degrees, and 270 degrees, respectively. In other configurations, the end-fire antennas may be arranged for two orthogonal directions, respectively. In one example of such configurations, the end-fire antennas 21 and 22 may be arranged for the directions of azimuth angles of 0 degree and 90 degrees, respectively, and no end-fire antennas may be arranged for the directions of azimuth angles of 180 degrees and 270 degrees.

Second Embodiment

Figure 2:
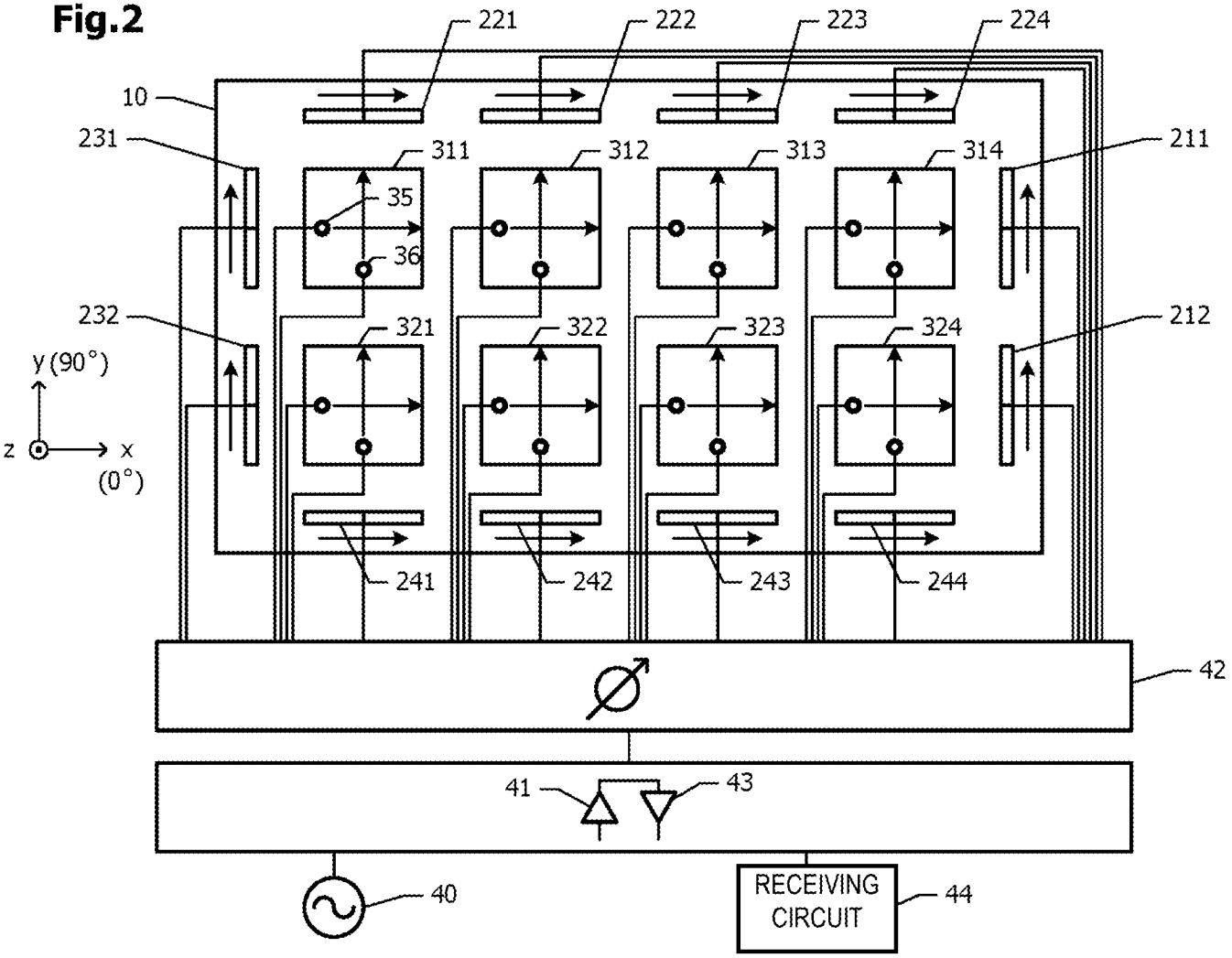
FIG. 2 is a plan view of a wireless communication module according to a second embodiment.

FIG. 2 is a plan view of a wireless communication module according to a second embodiment. The differences from the wireless communication module according to the first embodiment illustrated in FIG. 1 are described below, and the description about the same configurations is omitted.

In the first embodiment, one end-fire antenna is arranged for each of the sides of the dielectric substrate 10. In the second embodiment, a plurality of end-fire antennas are arranged for each of the sides of the dielectric substrate 10. Two end-fire antennas 211 and 212 are arranged for the side facing the direction of an azimuth angle of 0 degree. Four end-fire antennas 221 to 224 are arranged for the side facing the direction of an azimuth angle of 90 degrees. Two end-fire antennas 231 and 232 are arranged for the side facing the direction of an azimuth angle of 180 degrees. Four end-fire antennas 241 to 244 are arranged for the side facing the direction of an azimuth angle of 270 degrees. A balanced feeder and a balun are connected to each of the end-fire antennas, like in the first embodiment illustrated in FIG. 1.

In the first embodiment, the single patch antenna 30 is arranged on the dielectric substrate 10. In the second embodiment, a plurality of patch antennas 311 to 314 and 321 to 324 are arranged. Each of the patch antennas 311 to 314 and 321 to 324 is provided with the first feed point 35 and second feed point 36.

When the x-axis direction is a row direction and the y-axis direction is a column direction, the patch antennas 311 to 314 and 321 to 324 have an array antenna structure in which they are aligned in a matrix with 2 rows and 4 columns. The patch antennas 311 to 314 are arranged in the first row and aligned in this order toward the positive side in the x-axis direction. The patch antennas 321 to 324 are arranged in the second row and aligned in this order toward the positive side in the x-axis direction.

The end-fire antennas 211, 212, 231, and 232 and patch antennas 311 to 314 and 321 to 324 are arranged in a matrix with two rows and six columns. The end-fire antennas 211 and 231 are arranged in the first row, and the end-fire antennas 212 and 232 are arranged in the second row. When the second feed point 36 in each of the patch antennas 311 to 314 and 321 to 324 is fed, the end-fire antennas 211, 212, 231, and 232 and patch antennas 311 to 314 and 321 to 324 operate as a two-dimensional array antenna in which they are arranged in a matrix with two rows and six columns. This two-dimensional array antenna has the polarization characteristics being parallel with the y axis.

The end-fire antennas 221 to 224 and 241 to 244 and patch antennas 311 to 314 and 321 to 324 are arranged in a matrix with four rows and four columns. The end-fire antennas 221 and 241 are arranged in the first row, the end-fire antennas 222 and 242 are arranged in the second row, the end-fire antennas 223 and 243 are arranged in the third row, and the end-fire antennas 224 and 244 are arranged in the fourth row. When the first feed point 35 in each of the patch antennas 311 to 314 and 321 to 324 is fed, the end-fire antennas 221 to 224 and 241 to 244 and patch antennas 311 to 314 and 321 to 324 operate as a two-dimensional array antenna in which they are arranged in a matrix with four rows and four columns. This two-dimensional array antenna has the polarization characteristics being parallel with the x axis.

In the first embodiment, the wave angle of the main lobe can be changed, but the azimuth angle cannot be changed. In the second embodiment, because the end-fire antennas 211, 212, 221 to 224, 231, 232, and 241 to 244 and patch antennas 311 to 314 and 321 to 324 operate as two-dimensional array antennas, both the wave angle of the main lobe and the azimuth angle can be changed.

Third Embodiment

Figure 3:
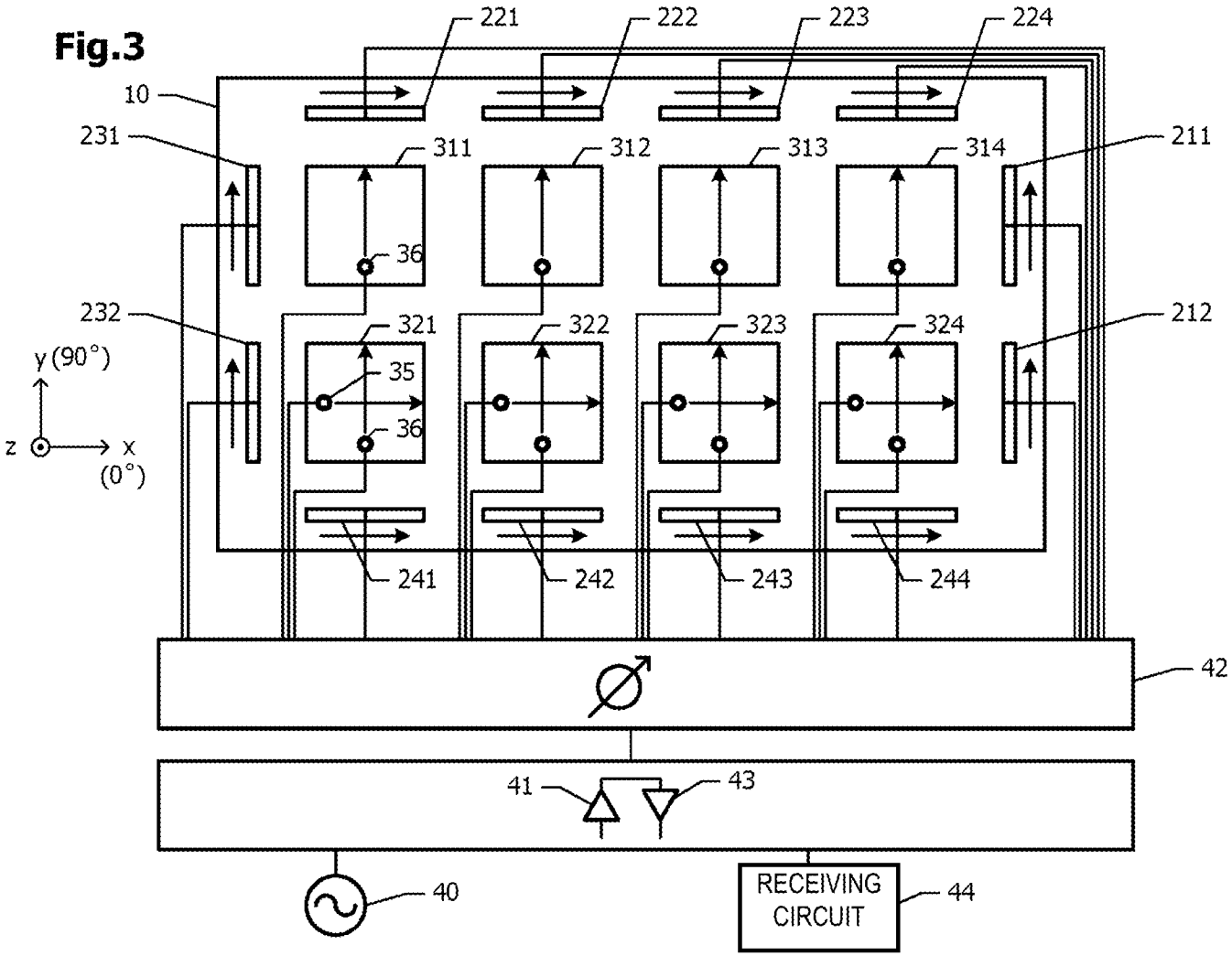
FIG. 3 is a plan view of a wireless communication module according to a third embodiment.

FIG. 3 is a plan view of a wireless communication module according to a third embodiment. The differences from the wireless communication module according to the second embodiment illustrated in FIG. 2 are described below, and the description about the same configurations is omitted.

In the second embodiment, as illustrated in FIG. 2, each of all the patch antennas 311 to 314 and 321 to 324 is provided with the first feed point 35 and second feed point 36. In the third embodiment, each of the patch antennas 311 to 314 in the first row is provided with the second feed point 36, but is not provided with the first feed point 35. Each of the patch antennas 321 to 324 is provided with both the first feed point 35 and second feed point 36.

The number of patch antennas aligned in the x-axis direction is larger than that in the y-axis direction. Each of the patch antennas 321 to 324 among the patch antennas is fed from a feed point selected from the first feed point 35 and second feed point 36, whereas each of the remaining patch antennas 311 to 314 is fed from only the second feed point 36. The patch antennas 311 to 314, which are fed from one feed point, or the patch antennas 321 to 324, which are fed from two feed points, belong to a single row. In a single column, one of the one-feed-point patch antennas 311 to 314 and one of the two-feed-point patch antennas 321 to 324 coexist.

Because the patch antennas 311 to 314 are not provided with the first feed points 35, the number of digital phase shifters 42 can be reduced. A polarized wave parallel with the y axis is excited by 12 antennas in total consisting of the end-fire antennas 211, 212, 231, and 232 and the patch antennas 311 to 314 and 321 to 324. A polarized wave parallel with the x axis is excited by 12 antennas in total consisting of the end-fire antennas 221 to 224 and 241 to 244 and the patch antennas 321 to 324. The polarized wave parallel with the x axis is not exited by the patch antennas 311 to 314. The number of antennas configured to excite the polarized wave parallel with the x axis and the number of antennas configured to excite the polarized wave parallel with the y axis are the same. Thus, the radiation characteristics for two polarized waves can be matched with each other.

In the third embodiment, the number of antennas configured to excite the polarized wave parallel with the x axis and the number of antennas configured to excite the polarized wave parallel with the y axis are the same. In other arrangements, the number of antennas may be different. One example of such arrangements may be the one in which a one-feed-point patch antenna and a two-feed-point patch antenna coexist in a direction in which a smaller number of antennas (in FIG. 3, y direction) are arranged out of the row direction and column direction. In that arrangement, the difference between the number of antennas configured to excite a polarized wave parallel with the x axis and that with the y axis can be small.

Fourth Embodiment

Figure 4:
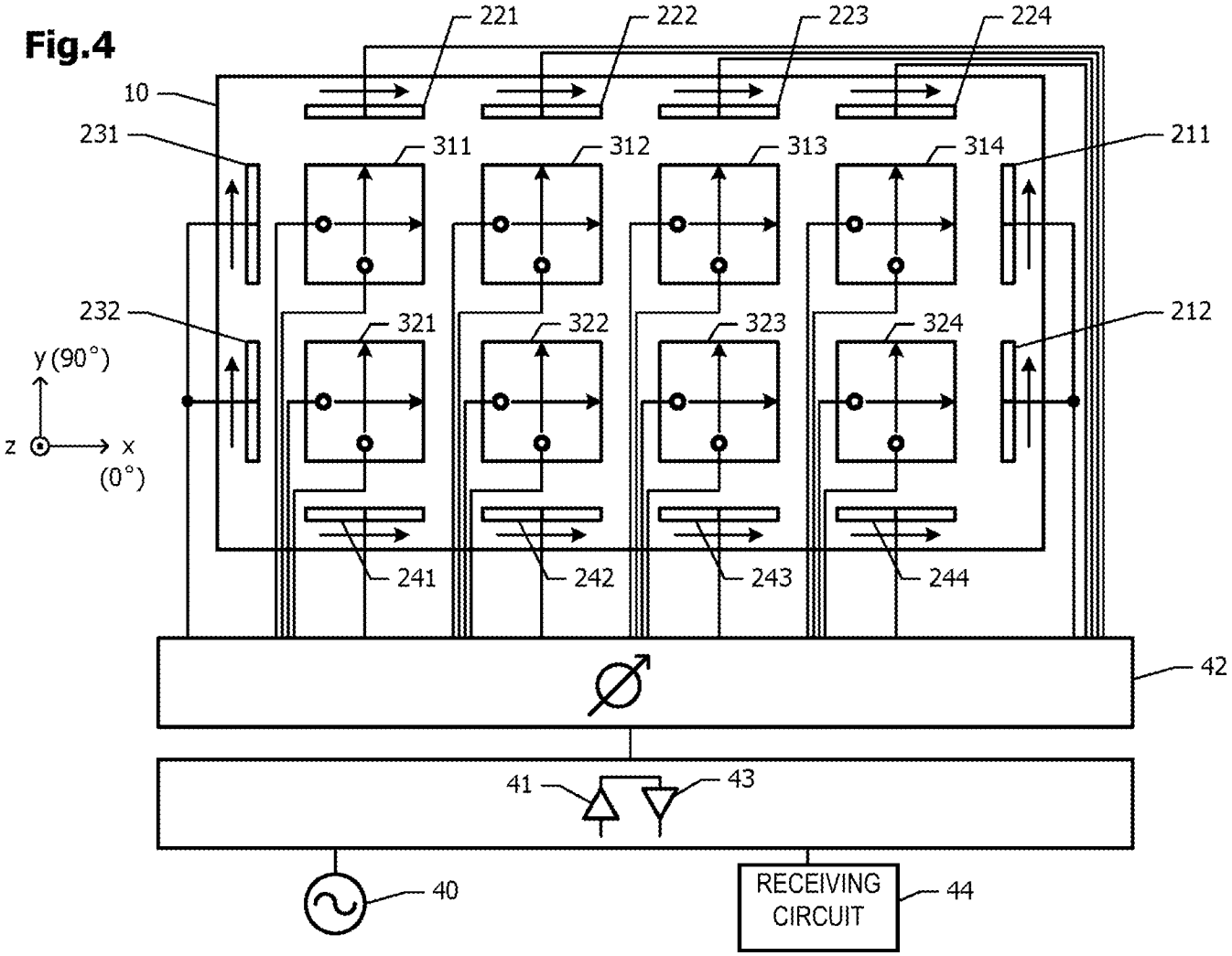
FIG. 4 is a plan view of a wireless communication module according to a fourth embodiment.

FIG. 4 is a plan view of a wireless communication module according to a fourth embodiment. The differences from the wireless communication module according to the second embodiment illustrated in FIG. 2 are described below, and the description about the same configurations is omitted.

In the second embodiment, as illustrated in FIG. 2, the phase of a high-frequency signal supplied to the end-fire antenna 211 and that to the end-fire antenna 212 can be independently adjusted. Similarly, the phase of a high-frequency signal supplied to the end-fire antenna 231 and that to the end-fire antenna 232 can be independently adjusted. In the fourth embodiment, high-frequency signals of the same phase are supplied to the end-fire antennas 211 and 212 from a shared feeder. High-frequency signals of the same phase are also supplied to the end-fire antennas 231 and 232 from a shared feeder.

High-frequency signals whose phases are adjusted independently of each other through the digital phase shifters 42 are supplied to the end-fire antennas 221 to 224.

In the wireless communication module according to the fourth embodiment, the directivity in the direction of an azimuth angle of 0 degree of each of the two end-fire antennas 211 and 212 can be sharpened. Similarly, the directivity in the direction of an azimuth angle of 180 degrees of each of the two end-fire antennas 231 and 232 can be sharpened. The number of the end-fire antennas 221 to 224 that have the directivity in the direction of an azimuth angle of 90 degrees, is larger than the number of the end-fire antennas 211 and 212 that have the directivity in the direction of an azimuth angle of 0 degree. Thus, even if the phases of high-frequency signals supplied to the end-fire antennas 221 to 224 are not matched with each other, the directivity in the direction of an azimuth angle of 90 degrees can be sufficiently sharpened. Similarly, the directivity in the direction of an azimuth angle of 270 degrees can also be sharpened.

Furthermore, in the fourth embodiment, a single digital phase shifter 42 is arranged for the end-fire antennas 211 and 212, and another single digital phase shifter 42 is arranged for the end-fire antennas 231 and 232. Thus, the number of the digital phase shifters 42 can be reduced.

Fifth Embodiment

Figure 5:
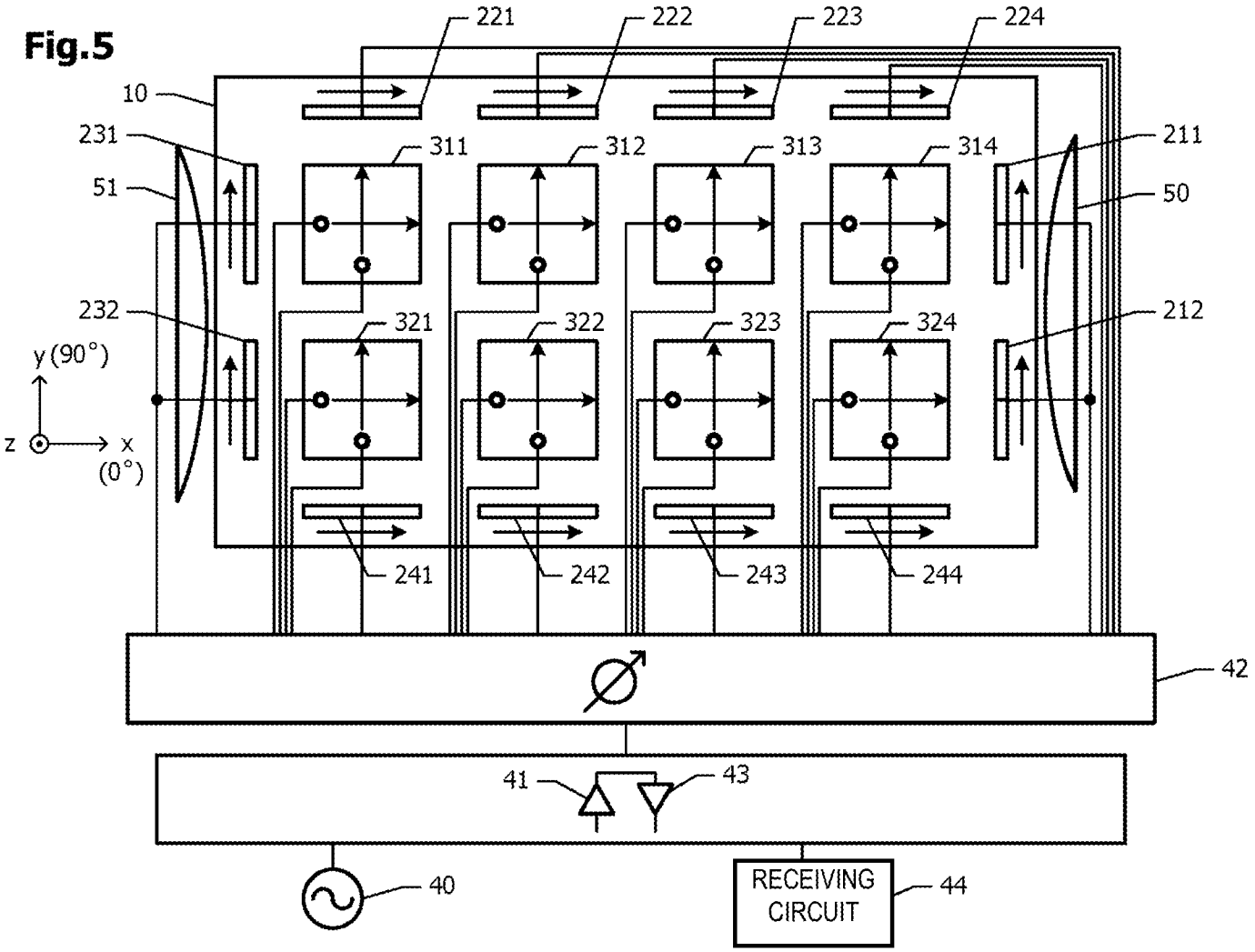
FIG. 5 is a plan view of a wireless communication module according to a fifth embodiment.

FIG. 5 is a plan view of a wireless communication module according to a fifth embodiment. The differences from the wireless communication module according to the fourth embodiment illustrated in FIG. 4 are described below, and the description about the same configurations is omitted.

In the fifth embodiment, an electromagnetic lens 50 is arranged in front of the end-fire antennas 211 and 212. The electromagnetic lens 50 converges radio waves radiated by the end-fire antennas 211 and 212. An electromagnetic lens 51 is also arranged in front of the end-fire antennas 231 and 232. The electromagnetic lens 51 converges radio waves radiated by the end-fire antennas 231 and 232.

By the placement of the electromagnetic lenses 50 and 51, the directivity in the direction of an azimuth angle of 0 degree and the directivity in the direction of an azimuth angle of 180 degrees can be further sharpened.

Sixth Embodiment

Figures 6A, 6B:
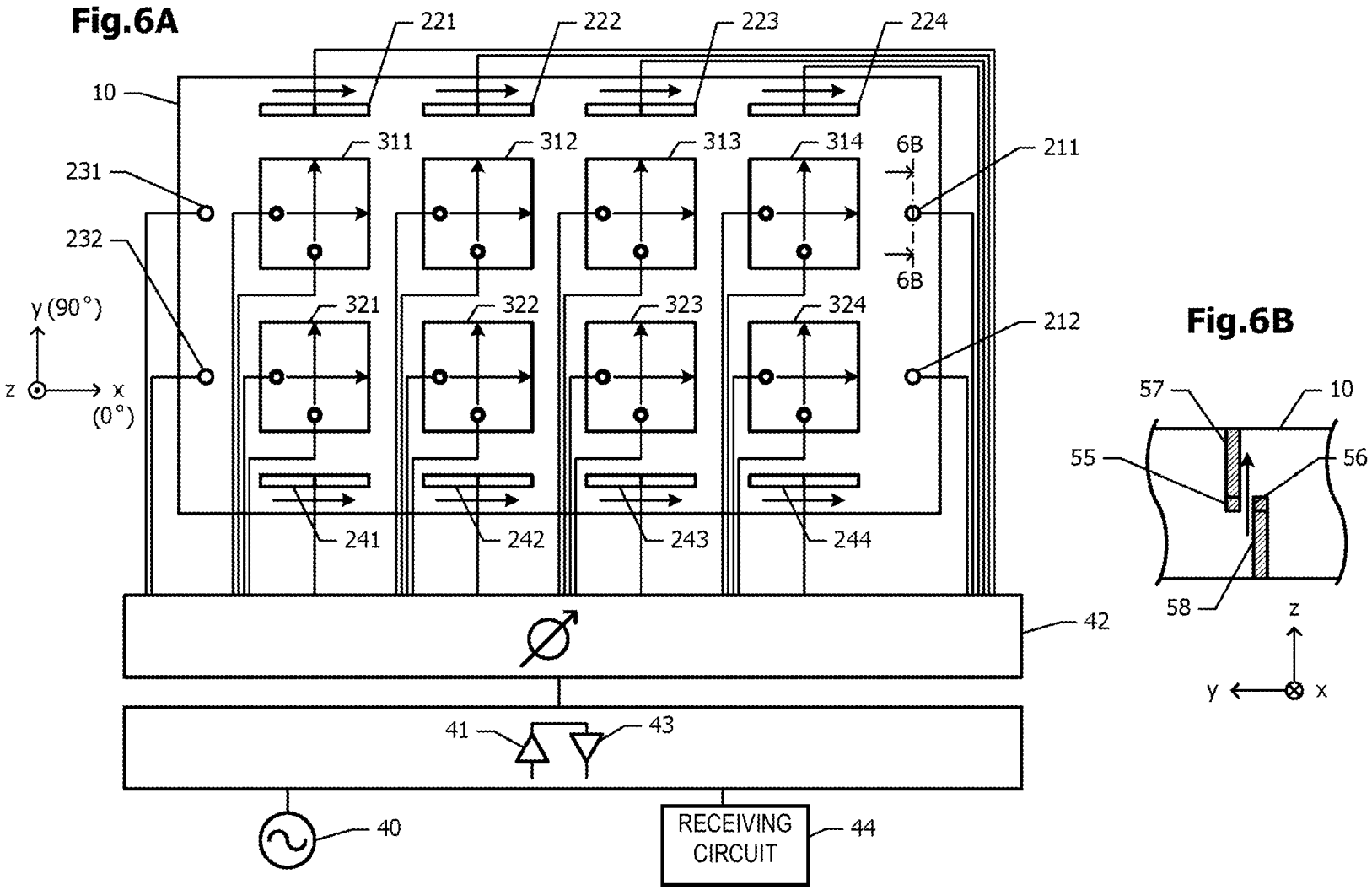
FIGS. 6A and 6B is a plan view of a wireless communication module according to a sixth embodiment.

FIG. 6A is a plan view of a wireless communication module according to a sixth embodiment. The differences from the wireless communication module according to the second embodiment illustrated in FIG. 2 are described below, and the description about the same configurations is omitted.

In the second embodiment, the end-fire antennas 211, 212, 231, and 232 excite a polarized wave parallel with the y axis. In the sixth embodiment, the end-fire antennas 211, 212, 231, and 232 excite a polarized wave parallel with the z axis (thickness direction of the dielectric substrate 10).

FIG. 6B is a cross-sectional view taken along a dot-and-dash line 6B-6B in FIG. 6A. Feeders 55 and 56 are arranged inside the dielectric substrate 10. A conductive pillar 57 extends upwardly from the one feeder 55. A conductive pillar 58 extends downwardly from the other feeder 56. The conductive pillars 57 and 58 constitute a dipole antenna that is long in the z direction.

In the sixth embodiment, because the end-fire antennas 211, 212, 231, and 232 excite a polarized wave parallel with the z axis, the sensitivity to polarized waves in the thickness direction of the dielectric substrate 10 can be enhanced.

Seventh Embodiment

Figure 7:
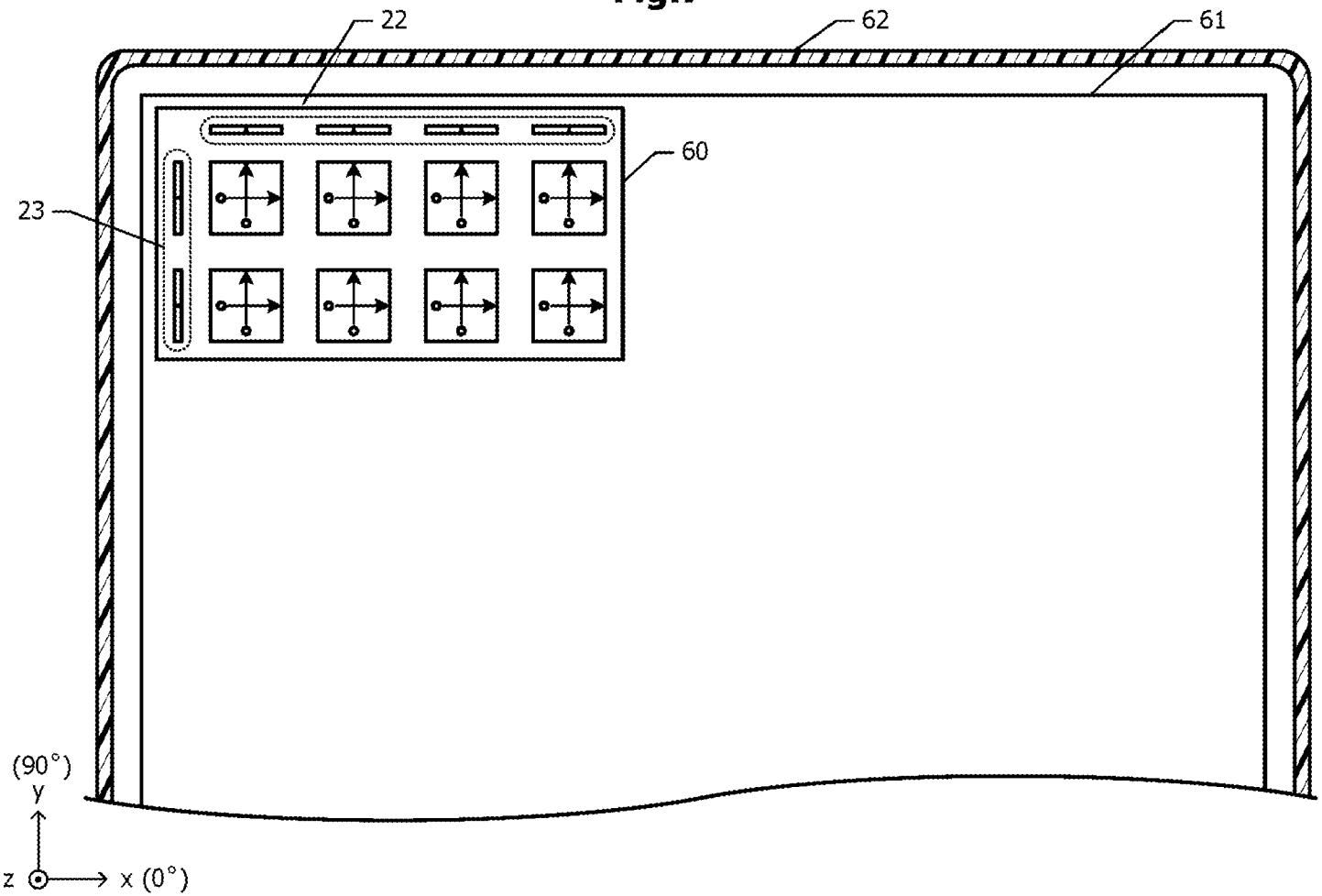
FIG. 7 is a partial schematic cross-sectional view of a wireless device according to a seventh embodiment.

FIG. 7 is a partial schematic cross-sectional view of a wireless device according to a seventh embodiment. Examples of the wireless device according to the seventh embodiment may include a portable wireless terminal and a home electrical appliance. A wireless communication module 60 is mounted on a mother board 61. As the wireless communication module 60, a wireless communication module according to any one of the first to sixth embodiments is used. The mother board 61 is housed in a radome 62.

One example of the wireless communication module 60 is mounted on a corner portion between the side facing the direction of an azimuth angle of 90 degrees and the side facing the direction of an azimuth angle of 180 degrees in the mother board 61. The end-fire antennas 22 (FIG.7) that face the inner portion in the mother board 61 and have the directivity in the direction of an azimuth angle of 0 degree, and the end-fire antennas 23 (FIG.7) that have the directivity in the direction of an azimuth angle of 270 degrees, are omitted. The radome 62 is arranged in front of the end-fire antennas 22 and 23.

Like in the wireless device according to the seventh embodiment, a suitable arrangement of end-fire antennas may preferably be selected based on the positional relationship between the wireless communication module 60 and mother board 61, the positional relationship between the wireless communication module 60 and radome 62, and another factor.

It should be noted that the above-described first to seventh embodiments are illustrative, and the configurations described in different embodiments may be partially replaced or combined. Similar operational advantages from similar configurations in a plurality of embodiments are not described in detail. The present disclosure is not limited to the above-described embodiments. For example, various modifications, improvements, combinations may be apparent to those skilled in the art.

10 dielectric substrate
21 to 24 end-fire antenna
25 balanced feeder
26 balun (balanced-to-unbalanced transformer)
27 node
28 reflector pattern
30 patch antenna
35 first feed point
36 second feed point
40 transmitting circuit
41 power amplifier
42 digital phase shifter
43 low-noise amplifier
44 receiving circuit
50, 51 electromagnetic lens
55, 56 feeder
57, 58 conductive pillar
60 wireless communication module
61 mother board
62 radome
211, 212, 221 to 224, 231, 232, 241 to 244 end-fire antenna
311 to 314, 321 to 324 patch antenna

The invention claimed is:

1. A wireless communication module comprising:

a dielectric substrate;

at least one first end-fire antenna arranged on the dielectric substrate, having directivity in a direction parallel with a surface of the dielectric substrate, and having polarization characteristics being parallel with a first direction;

at least one second end-fire antenna arranged on the dielectric substrate, having directivity in the direction parallel with the surface of the dielectric substrate, and having polarization characteristics being parallel with a second direction orthogonal to the first direction; and at least one patch antenna arranged on the dielectric substrate and provided with a first feed point and a second feed point, the first and second feed points being different from each other, wherein when the patch antenna is fed from the first feed point, a radio wave having a polarization direction parallel with the first direction is excited, and when the patch antenna is fed from the second feed point, a radio wave having a polarization direction orthogonal to the first direction is excited.

2. The wireless communication module according to claim 1, wherein when the patch antenna is fed from the second feed point, a radio wave having a polarization direction parallel with the second direction is radiated.

3. The wireless communication module according to claim 2, wherein the at least one patch antenna comprises a plurality of patch antennas having an array antenna structure aligned in a matrix in the first direction and the second direction.

4. The wireless communication module according to claim 3, wherein a number of the patch antennas aligned in the first direction is larger than a number of the patch antennas aligned in the second direction, each of some of the patch antennas is configured to be fed from the first feed point and the second feed point, and each of remaining ones of the patch antennas is configured to be fed from only the second feed point.

5. The wireless communication module according to claim 3, wherein the at least one first end-fire antenna comprises a plurality of first end-fire antennas having an array antenna structure aligned in the first direction, and the at least one second end-fire antenna comprises a plurality of second end-fire antennas having an array antenna structure aligned in the second direction.

6. The wireless communication module according to claim 5, wherein high-frequency signals having phases adjusted independently of each other through phase shifters are supplied to the first end-fire antennas, and high-frequency signals having a same phase as supplied to the first end-fire antennas are supplied to the second end-fire antennas.

7. eless communication module according to claim 3, wherein a number of the patch antennas aligned in the first direction is larger than a number of the patch antennas aligned in the second direction, and the wireless communication module further comprises an electromagnetic lens configured to converge radio waves radiated by the second end-fire antenna.

8. The wireless communication module according to claim 1, wherein one of the first direction and the second direction is parallel with the surface of the dielectric substrate, and another direction is parallel with a thickness direction of the dielectric substrate.

9. The wireless communication module according to claim 4, wherein the at least one first end-fire antenna comprises a plurality of first end-fire antennas having an array antenna structure aligned in the first direction, and the at least one second end-fire antenna comprises a plurality of second end-fire antennas having an array antenna structure aligned in the second direction.

* * * * *